United States Patent [19]

Sullivan

[11] 4,252,433

[45] Feb. 24, 1981

[54] METHOD AND APPARATUS FOR REMOVING A RESIDUAL IMAGE IN AN ELECTROSTATIC COPYING SYSTEM

[75] Inventor: William A. Sullivan, Webster, N.Y.

[73] Assignee: Xerox Corporation, Stamford, Conn.

[21] Appl. No.: 362,691

[22] Filed: May 22, 1973

Related U.S. Application Data

[60] Continuation of Ser. No. 129,145, Mar. 29, 1971, abandoned, which is a division of Ser. No. 755,265, Aug. 26, 1968, Pat. No. 3,634,077.

[51] Int. Cl.[3] ..... G03G 15/22

[52] U.S. Cl. ..... 355/15; 15/1.5 R; 15/52; 15/256.51; 259/129; 430/125

[58] Field of Search ..... 355/15; 15/256.51, 256.52, 15/256.53; 96/1 R

[56] References Cited

U.S. PATENT DOCUMENTS

| | | | |
|---|---|---|---|
| 351,314 | 10/1886 | Delmage | 15/1.5 R |
| 2,558,900 | 7/1951 | Hooper | 96/1 R |
| 2,576,047 | 11/1951 | Schaffert | 96/1.4 X |
| 2,844,123 | 7/1958 | Hayford | 96/1 SD |
| 3,186,838 | 6/1965 | Graff et al. | 96/1.4 |
| 3,572,923 | 3/1971 | Fisher et al. | 355/15 |

*Primary Examiner*—Roland E. Martin, Jr.

*Attorney, Agent, or Firm*—Harvey M. Brownrout; Peter H. Kondo; James Paul O'Sullivan

[57] ABSTRACT

A method and apparatus for recovering the residual image from an electrostatic recording surface in an electrostatic copying system which is accomplished by presenting a wiping element in pressure contact with the residual image on the recording surface whereby the residual image is substantially removed therefrom, moving a conductive member in close proximity to the toner particles being removed from the recording surface, applying a DC voltage opposite in polarity to that of the toner particles and of sufficient magnitude to the conductive member whereby the toner particles are attracted onto the surface of the conductive member, and continuously removing the toner particles from the conductive member into a collection zone for reuse in the copying system.

2 Claims, 1 Drawing Figure

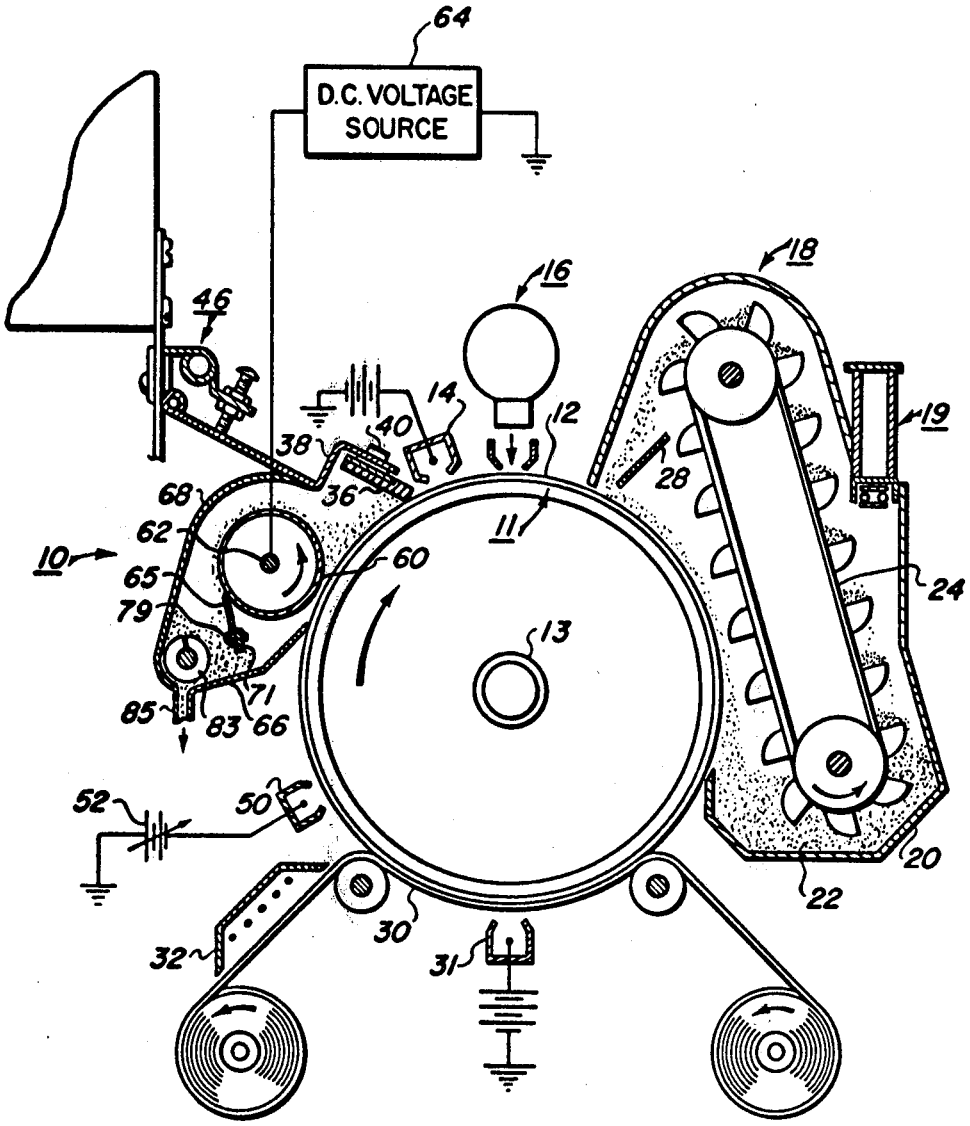
64
D.C. VOLTAGE SOURCE
16
18
46
14
12
19
40
38
28
68
36
62
11
10
60
24
65
79
13
71
85
83
66
52
50
20
22
30
32
31

METHOD AND APPARATUS FOR REMOVING A RESIDUAL IMAGE IN AN ELECTROSTATIC COPYING SYSTEM

This is a continuation, of application Ser. No. 129,145, filed Mar. 29, 1971, now abandoned, which in turn is a Division of application Ser. No. 755,265, filed Aug. 26, 1968, now U.S. Pat. No. 3,634,077.

This invention relates to electrostatic imaging systems and more particularly, to an improved apparatus for cleaning electrostatic recording surfaces.

The formation and development of images on the surface of recording materials by electrostatic means is well known. One basic process, as taught by Chester F. Carlson, in U.S. Pat. No. 2,297,691, involved placing a uniform electrostatic charge on a photoconductive insulating layer, exposing the layer to a light-and-shadow image to dissipate the charge on the areas of the layer exposed to the light and developing the resulting latent electrostatic image by depositing on the image a finely divided electroscopic powder material referred to in the art as "toner". The toner is normally attracted to those areas of the layer which retain a charge, thereby forming a toner image corresponding to the latent electrostatic image. This powder image may then be transferred to a support surface such as paper. The transferred image may subsequently be permanently affixed to a support surface. After cleaning, the layer is ready for another imaging cycle.

As is well known in recent years, the steadily increasing size of various industries has required an enormous increase in the amount of paper work that must be accomplished, maintained and made available for wide interplant circulation. In the present day commercial automatic copier/reproduction machines, the electrostatic recording surface is in the form of a drum or belt which moves at high rates in timed unison relative to a plurality of processing stations. This rapid movement of the electrostatic recording surface has required vast amounts of toner particles during development resulting in greater difficulty in removing the residual image remaining on the recording surface after transfer.

Several techniques are known for cleaning the residual image from the recording surfaces such as the "brush" type apparatus as described in U.S. Pat. No. 2,832,977 and the "web" type apparatus as described in U.S. Pat. No. 3,186,838. The present invention is an improvement over the existing techniques and is also intended as an improvement over the cleaning technique described in copending application Ser. No. 702,306 filed on Feb. 1, 1968 for cleaning a recording surface.

It is, therefore, an object of this invention to improve the cleaning of recording surfaces used in electrostatic reproduction machines.

It is a further object of this invention to reduce toner consumption in automatic electrostatic imaging machines.

It is also an object of this invention to utilize cleaning apparatus in reproduction equipment which does not require extensive alignment or adjustment.

It is still another object of this invention to remove residual toner which is immediately reusable in an electrostatic imaging system.

It is a further object of this invention to provide simple, inexpensive and reusable apparatus for cleaning electrostatic recording surfaces.

It is still a further object of this invention to provide cleaning apparatus for an electrostatic imaging system which is more efficient than existing cleaning devices.

It is still a further object of this invention to prevent powder cloud formation at the cleaning station of copier/duplicator machines.

It is still a further object of this invention to reduce the noise level of copier/duplicator machines.

These and other objects of the invention are attained, generally speaking, by wiping the electrostatic recording surface with a cleaning blade in pressure contact with the surface to mechanically remove the toner particles from the surface. At the same time, an electrical potential of a polarity opposite that of the toner particles and of sufficient magnitude is applied to roll means positioned adjacent the cleaning blade to attract the toner particles from the vicinity of the blade onto the roll means thereby recovering substantially all of the toner particles removed from the recording surface and also preventing the formation of a cloud. The toner particles are then removed from the electrically biased roll means and collected for reuse in the copying system.

For a better understanding of the invention as well as other objects and further features thereof, reference is had to the following detailed description of the invention to be read in conjunction with the accompanying drawing, the single FIGURE of which is a partly schematic, cross-sectional side elevational view of a reproduction machine incorporating cleaning apparatus according to the present invention.

Referring to the drawing, an automatic copier machine is shown employing a cleaning apparatus 10 for cleaning a residual image from an electrostatic recording member 11. Recording member 11 is formed in the shape of a drum having an outer layer 12 of suitable photoconductive insulating material, such as, vitreous selenium, and is mounted on a shaft 13 to move in the direction indicated by the arrow past several processing stations.

As in most electrostatic recording machines, the surface of photoconductive insulating layer 12 is uniformly charged by a corona charging device 14. Next the drum surface is exposed to a pattern of activating electromagnetic radiation as by an optical projector 16 to form an electrostatic latent image.

The latent electrostatic image formed is then developed in any suitable manner as by a developing apparatus 18. Developer apparatus 18 comprises a developer housing 20 having a lower reservoir or sump portion for accumulating developer material 22. Any suitable developer material containing electroscopic toner particles can be used such as that described, for example, in the copending application referred to above or in U.S. Pat. No. 2,618,551 to Walkup, U.S. Pat. No. 2,618,552 to Wise, U.S. Pat. No. 2,638,416 to Walkup and Wise, and U.S. Pat. Re. No. 25,136 to Carlson. For positive to positive reproduction, a negatively charged toner is used, whereas in a negative to positive reproduction, a positively charged toner is used. Mounted within the developer housing 20 is a driven buckettype conveyor 24 used to carry the developer material from the sump to the upper portion of the developer housing 20 from where the developer material is cascaded over a hopper chute 28 onto the surface of the photoconductive layer 12.

As the developer material cascades over the drum, toner particles in the developer material adhere electrostatically to the previously formed electrostatic latent image areas on the surface of the photoconductive layer 12 to form a visible xerographic powder image; the remaining developer material falling off the peripheral surface of the drum into the sump of the developer housing 20. Toner particles consumed during the developing operation to form the xerographic powder images are replenished by a toner dispenser 19, such as, the dispenser described in U.S. Pat. No. 3,013,703 to Hunt.

The developed image emerging from the developing apparatus is transferred to a moving web 30 made of any suitable material, such as, paper by a corona charging device 31. The transferred image may be permanently fixed to the web 30 by any suitable means such as by a heat fuser 32. After transfer, the drum surface is cleaned of residual toner particles by cleaning apparatus 10 as will be explained completing the recording cycle and readying the surface for another cycle in the manner already described. The cleaning apparatus of this invention is adapted to remove the residual toner material in such a manner that it can be reused with the developer material and at the same time be effective for continuous cleaning whereby replacement of the cleaning apparatus is not a concern.

Cleaning apparatus 10 comprises a substantially rectangular cleaning blade member 36 suitably secured to a blade holder 38 as by means of a shoulder screw 40. The cleaning blade 36 normally rests in pressure contact with the surface of photoconductive layer 12 due to the combined weight of the blade itself, the blade holder 38, and spring biasing assembly 46 which desirably is adjustable to vary the contact pressure. Cleaning blade 36 may be made of any suitable, non-metallic flexible material. Typical materials include polysiloxane rubber, polyurethane rubber, polytetrafluoroethylene resin, polytrifluorochloroethylene resin, styrene butadiene rubber, nitrile-silicone rubber, flexible polyurethane foam, polyethylene resin and blends, mixtures and copolymers thereof. The blade should be sufficiently soft to minimize abrasion of reusable imaging surfaces, particularly selenium type imaging surfaces. Preferably, the blade material should have a Shore hardness of less than about D65. Considerable latitude in blade thickness is permissible. However, the blade should be sufficiently thick to avoid collapse of the blade on the imaging surface under the blade pressure conditions employed.

As the leading edge or face of blade member 36 contacts the drum surface 12 the residual toner particles are continuously removed from the surface by a scraping action. To collect these particles for reuse in the system, there is positioned in close proximity with the blade member and drum surface a bias roll member 60 adapted for rotation on a shaft 62 driven to obtain about the same peripheral speed between the roll and drum surface in the direction indicated by the arrow. Bias roll member 60 is made out of a suitable conductive material and is connected to a variable source of DC voltage 64 which is of a polarity opposite to that of the toner particles and of sufficient magnitude to attract toner particles removed by blade 36 onto the roll surface. DC voltage 64 desirably ranges from about 500 volts to about 5000 volts to achieve efficient removal of the toner particles and to prevent any undesirable cloud formation in the vicinity of the drum surface.

In order to further enhance the electrostatic attraction of the toner particles onto the bias roll member 60, corona generating device 50 is positioned in the path of the drum after the transfer step but before the cleaning blade to place a charge on the residual toner particles of the same polarity as the particles which in this case would be negative. This charge desirably reduces the attraction of the toner particles to the surface of the drum and ensures that the toner particles are properly negatively charged so that they will be attracted to the positive potential applied by DC voltage 64. It has been found that a current ranging from about 2 to about 10 microamps for the corona device is sufficient for this purpose. Corona device 50 is suitably powered as by a variable source of DC voltage 52.

To enable continuous cleaning action and to recover the toner particles so that they may be retained and reused in the development system of the machine, a scraper member 65 is positioned in the path of bias roll member 60 to remove the particles for collection in sump 66 in the lower portion of a housing 68. Scraper member 65 is made of any suitable metallic or non-metallic material and is connected to housing 68 by one or more insluating block members 71 as by screws 79. If desired, contact pressure of the scraper member 65 with the surface of roll member 60 may be adjustable in any suitable manner as by a spring.

As the toner particles are collected in sump 66 they are desirably removed by an auger member 81 mounted for rotation on a shaft 83 journaled in housing 68. Auger member 81 rotates through the toner material collected in the tray in a direction shown by the arrow to move the toner toward one or more conduits 85 from which the toner particles are discharged either by gravity or any other suitable means for reuse at the development station.

Above is described a new and novel cleaning apparatus capable of removing substantially all of the residual toner particles on the surface of an electrostatic recording member and for collecting the toner for reuse in the copier/duplicating machine. Heretofore, cleaning of the recording surface was accomplished by a rotating brush or web which had to be discarded and replaced after periodic use and which prevented the toner from being reused in the development system again. With the present invention, the toner particles are removed from the recording surface in such a manner that objectionable filming of the toner does not occur and hence the toner is adapted for reuse in the system repeatedly. Furthermore, no powder cloud is formed at the cleaning station which undesirably can cause a malfunction of the machine. Also, the cleaning apparatus of the present invention does not require extensive repair or adjustment as in the case of the prior art cleaning devices. Thus, the apparatus of the invention not only provides very efficient cleaning but is also inexpensive and reusable while permitting toner collected to be used repeatedly in the copying system. Hence the invention is greatly desirable for producing high quality prints in automatic copying machines at very high rates.

This application specifically describes one form which the invention may assume in practice. It will be understood that this form is the same as shown for purposes of illustration and that the invention may be modified and embodied in various other forms without departing from the scope of the appended claims.

What is claimed is:

1. In an automatic electrostatic copying system wherein an electrostatic latent image formed on the surface of a sensitized plate member is moved past a series of processing stations including a development station at which the latent image is developed by electroscopic toner particles, a transfer station at which the toner particles are transferred to a support sheet, and wiper means including a blade member arranged for engaging along an edge thereof a plate surface from which electrostatically adhering toner particles are to be removed, said edge being axially coextensive with said plate surface and adapted to remove toner particles contacted during relative movement between said blade member and said surface, the improvement comprising;

electrically conductive roll means positioned adjacent said edge of said blade member and extending axially parallel thereto, said roll means being spaced from said recording surface, a DC voltage source coupled to said conductive roll means, said source being of a polarity opposite that of said toner particles and of a magnitude sufficient to attract the toner particles being removed along the edge of said blade member onto the surface thereof, said DC voltage ranging from about 500 volts to about 5000 volts, and means for continuously removing the toner particles from the surface of said roll means for deposit into a collection source whereby said toner particles can be reused repeatedly at the development station.

2. The copying system of claim 1 wherein said means for removing toner particles from the surface of said roll means is a blade means for continuously wiping the toner particles from said surface.

* * * * *